US012575638B2

(12) United States Patent
Chen et al.

(10) Patent No.: US 12,575,638 B2
(45) **Date of Patent: *Mar. 17, 2026**

(54) SOLE STRUCTURE FOR ARTICLE OF FOOTWEAR

(71) Applicant: NIKE, Inc., Beaverton, OR (US)

(72) Inventors: Yuchung K. Chen, Portland, OR (US); Joël Ryp Greenspan, Portland, OR (US); Oliver McLachlan, Beaverton, OR (US); Stuart Reinhardt, Portland, OR (US); Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/944,388

(22) Filed: Nov. 12, 2024

(65) Prior Publication Data

US 2025/0064167 A1 Feb. 27, 2025

Related U.S. Application Data

(63) Continuation of application No. 18/295,640, filed on Apr. 4, 2023, now Pat. No. 12,167,767, which is a (Continued)

(51) Int. Cl.

| | |
|---|---|
| ***A43B 13/12*** | (2006.01) |
| ***A43B 5/02*** | (2006.01) |
| ***A43B 13/14*** | (2006.01) |

(52) U.S. Cl.

CPC ..... *A43B 13/125* (2013.01); *A43B 5/02* (2013.01); *A43B 13/14* (2013.01)

(58) Field of Classification Search

CPC ..... A43B 5/02; A43B 13/122; A43B 13/125; A43B 13/14; A43B 13/145; A43B 13/146; A43B 13/185; A43B 13/187

See application file for complete search history.

(56) References Cited

U.S. PATENT DOCUMENTS

| | | |
|---|---|---|
| D52,517 S | 10/1918 | Yennow |
| 2,268,057 A | 12/1941 | Newman |

(Continued)

OTHER PUBLICATIONS

European Patent Office (ISA), International Search Report and Written Opinion for PCT App. No. PCT/US2020/052355, dated Dec. 3, 2020.

*Primary Examiner* — Bao-Thieu L Nguyen

(74) *Attorney, Agent, or Firm* — Bookoff McAndrews PLLC

(57) ABSTRACT

A sole structure for an article of footwear includes a midsole having a medial edge and a lateral edge. The sole structure also include a first lower rib extending from the medial edge to the lateral edge of the midsole. The first lower rib includes a portion spaced from the midsole between the medial edge and the lateral edge. The sole structure further includes a medial flex member disposed between the midsole and the first lower rib near the medial edge and a lateral flex member disposed between the midsole and the first lower rib near the lateral edge. The medial flex member and the lateral flex member are configured to flex the first lower rib relative to the midsole in response to a force of a predetermined magnitude.

20 Claims, 8 Drawing Sheets

Related U.S. Application Data continuation of application No. 17/029,545, filed on Sep. 23, 2020, now Pat. No. 11,700,909.

(60) Provisional application No. 62/904,831, filed on Sep. 24, 2019.

(56) References Cited

U.S. PATENT DOCUMENTS 5,014,449 A * 5/1991 Richard ..... A43B 13/187 36/114
D334,276 S 3/1993 Feller et al.
5,337,492 A * 8/1994 Anderie ..... A43B 13/181 36/114
5,930,918 A * 8/1999 Healy ..... A43B 13/20 36/35 B
6,216,365 B1 4/2001 Cohen
D476,143 S 6/2003 McDowell
D541,022 S 4/2007 Hlavacs
D558,964 S 1/2008 Truelsen
7,350,320 B2 * 4/2008 Chandler ..... A43B 13/181 36/28
7,401,419 B2 * 7/2008 Lucas ..... A43B 1/0009 36/27
7,421,805 B2 9/2008 Geer
D583,542 S 12/2008 Gerber
7,549,239 B2 6/2009 Drollinger et al.
7,644,518 B2 * 1/2010 Chandler ..... A43B 21/26 36/27
7,818,897 B2 10/2010 Geer
7,941,945 B2 5/2011 Gerber
7,954,258 B2 6/2011 Gerber
8,079,161 B2 12/2011 Drollinger et al.
8,178,022 B2 * 5/2012 Schindler ..... A61K 31/713 264/261
8,220,185 B2 7/2012 Baker et al.
8,365,442 B2 2/2013 Baker et al.
8,387,279 B2 3/2013 Pauk et al.
8,453,344 B2 6/2013 Nishiwaki et al.
8,635,785 B2 1/2014 Seo
8,819,965 B2 9/2014 Baker et al.
8,978,272 B2 * 3/2015 Hurd ..... A43B 7/14 36/27
9,101,180 B2 8/2015 Baker et al.
9,468,251 B2 10/2016 Auger et al.
9,961,965 B2 * 5/2018 Miner ..... A43B 3/0052
10,111,492 B2 * 10/2018 Foxen ..... A43B 13/187
10,165,832 B2 * 1/2019 Miner ..... A43B 13/184
10,226,100 B2 3/2019 Auger et al.
10,238,175 B2 * 3/2019 Campos ..... A43B 13/125
11,019,881 B2 6/2021 Connell et al.
11,166,524 B2 * 11/2021 Case ..... A43B 13/20
11,700,909 B2 * 7/2023 Chen ..... A43B 13/14 36/25 R
12,167,767 B2 * 12/2024 Chen ..... A43B 13/187
2006/0265905 A1 * 11/2006 Chandler ..... A43B 13/188 36/25 R
2008/0155859 A1 * 7/2008 Chandler ..... A43B 13/186 36/35 R
2010/0186261 A1 7/2010 Baker et al.
2011/0138652 A1 * 6/2011 Lucas ..... A43B 13/14 36/28
2011/0146110 A1 6/2011 Geer
2013/0247422 A1 * 9/2013 Holt ..... A43B 13/206 36/83
2014/0115925 A1 * 5/2014 Hurd ..... A43B 13/125 156/182
2015/0157088 A1 * 6/2015 Seo ..... A43B 13/187 36/25 R
2017/0105480 A1 * 4/2017 Hurd ..... A43B 13/145
2017/0340061 A1 * 11/2017 Merlo ..... A43B 9/02
2018/0338575 A1 * 11/2018 Elder ..... A43B 13/145
2019/0281924 A1 * 9/2019 Connell ..... A43B 13/20

* cited by examiner

SOLE STRUCTURE FOR ARTICLE OF FOOTWEAR

CROSS REFERENCE TO RELATED APPLICATIONS

This application is continuation of and claims the benefit of priority to U.S. application Ser. No. 18/295,640, filed on Apr. 4, 2023, which is a continuation of U.S. application Ser. No. 17/029,545, filed on Sep. 23, 2020, now U.S. Pat. No. 11,700,909, which claims priority to U.S. Application No. 62/904,831, filed on Sep. 24, 2019, the entireties of which are incorporated herein by reference.

FIELD

The present disclosure relates generally to sole structures for articles of footwear and more particularly to sole structures incorporating a plurality of traction elements.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. The outsole may include one or more traction elements or cleats for engaging a ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. Sole structures may also include a comfort-enhancing insole or a sockliner located within a void proximate to the bottom portion of the upper and a strobel attached to the upper and disposed between the midsole and the insole or sockliner.

BRIEF DESCRIPTION OF THE DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
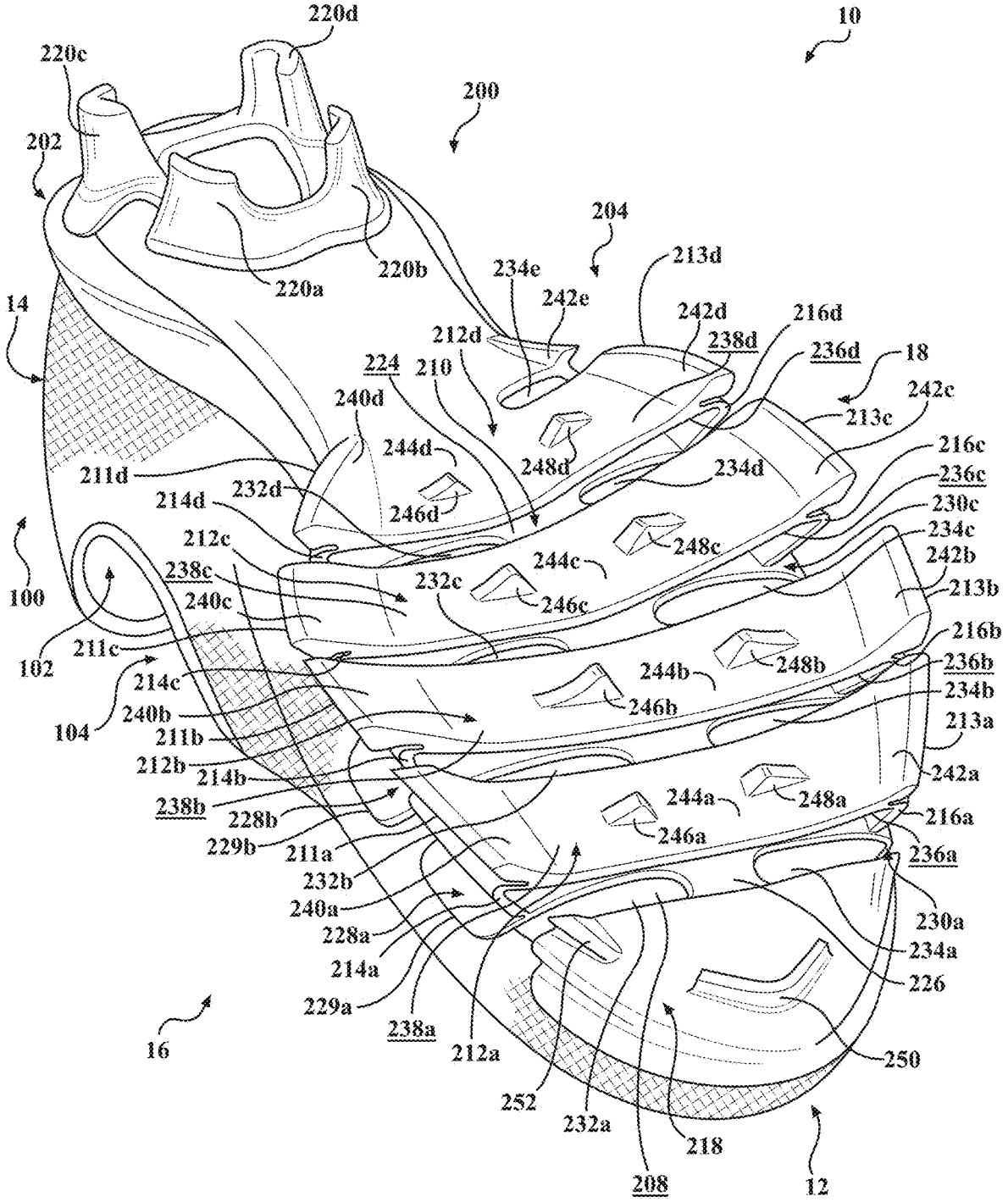
FIG. 1 is a bottom perspective view of an article of footwear having a sole structure in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure includes a midsole having a medial edge and a lateral edge. The sole structure also includes a first lower rib extending from the medial edge to the lateral edge of the midsole. The first lower rib includes a portion spaced from the midsole between the medial edge and the lateral edge. The sole structure further includes a medial flex member disposed between the midsole and the first lower rib near the medial edge and a lateral flex member disposed between the midsole and the first lower rib near the lateral edge. The medial flex member and the lateral flex member are configured to flex the first lower rib relative to the midsole in response to a force of a predetermined magnitude.

Implementations of this disclosure may include one or more of the following optional features. In some implementations, the sole structure includes a second lower rib extending from the medial edge to the lateral edge of the midsole, a second medial flex member disposed between the midsole and the second lower rib near the medial edge, and a second lateral flex member disposed between the midsole and the second lower rib near the lateral edge. Here, the second lower rib includes a portion spaced from the midsole between the medial edge and the lateral edge. In this implementation, the second medial flex member and the second lateral flex member are configured to flex the second lower rib relative to the midsole in response to a force of a predetermined magnitude. Optionally, the second lower rib may be spaced from the first lower rib along an axis extending from a heel region to a forefoot region of the article of footwear. The first lower rib and the second lower rib may be disposed in a forefoot region of the article of footwear. In some examples, the first lower rib is disposed in a forefoot region of the article of footwear. The first lower rib may be concave relative to the midsole.

In some configurations, the sole structure includes a bottom plate secured to the midsole. Here, the first lower rib may include an inner surface and an outer surface opposite the inner surface, the inner surface facing and being spaced from the bottom plate and the outer surface being configured to engage a ground surface. Optionally, a second lower rib may be spaced from the first lower rib along an axis extending from a heel region to a forefoot region of the article of footwear, here the bottom plate may define a gap exposing the midsole between the first lower rib and the second lower rib. The medial flex member and the lateral flex member may be one of foam members or fluid-filled chambers.

Another aspect of the disclosure provides a sole structure for an article of footwear. The sole structure includes a midsole having a medial edge and a lateral edge. The sole structure also includes a bottom plate secured to the midsole and extending from the medial edge to the lateral edge of the midsole. The sole structure further includes a first lower rib extending from the medial edge to the lateral edge of the midsole, the first lower rib including a portion spaced from the bottom plate between the medial edge and the lateral edge. The sole structure also includes a medial flex member extending from the bottom plate to the first lower rib near the medial edge and a lateral flex member extending from the bottom plate to the first lower rib near the lateral edge. The medial flex member and the lateral flex member are configured to flex the first lower rib relative to the bottom plate in response to a force of a predetermined magnitude.

Implementations of this aspect of the disclosure may include one or more of the following optional features. In some configurations, the sole structure includes a second lower rib extending from the medial edge to the lateral edge of the midsole, the second lower rib including a portion spaced from the bottom plate between the medial edge and the lateral edge. In this configuration, the sole structure also includes a second medial flex member extending from the bottom plate to the second lower rib near the medial edge and a second lateral flex member extending from the bottom plate to the second lower rib near the lateral edge. Here, the second medial flex member and the second lateral flex member are configured to flex the second lower rib relative to the bottom plate in response to a force of a predetermined magnitude. Optionally, the second lower rib may be spaced from the first lower rib along an axis extending from a heel region to a forefoot region of the article of footwear. The first lower rib and the second lower rib may be disposed in a forefoot region of the article of footwear. The bottom plate may define a gap exposing the midsole between the first lower rib and the second lower rib.

In some examples, the bottom plate defines a central spine along an axis extending from a heel region to a forefoot region of the article of footwear. The first lower rib may be disposed in a forefoot region of the article of footwear. The first lower rib may be convex relative to the bottom plate. The first lower rib may include an inner surface and an outer surface opposite the inner surface, the inner surface facing and being spaced from the bottom plate and the outer surface being configured to engage a ground surface. The medial flex member and the lateral flex member may be one of foam members or fluid-filled chambers.

Figure 3A:
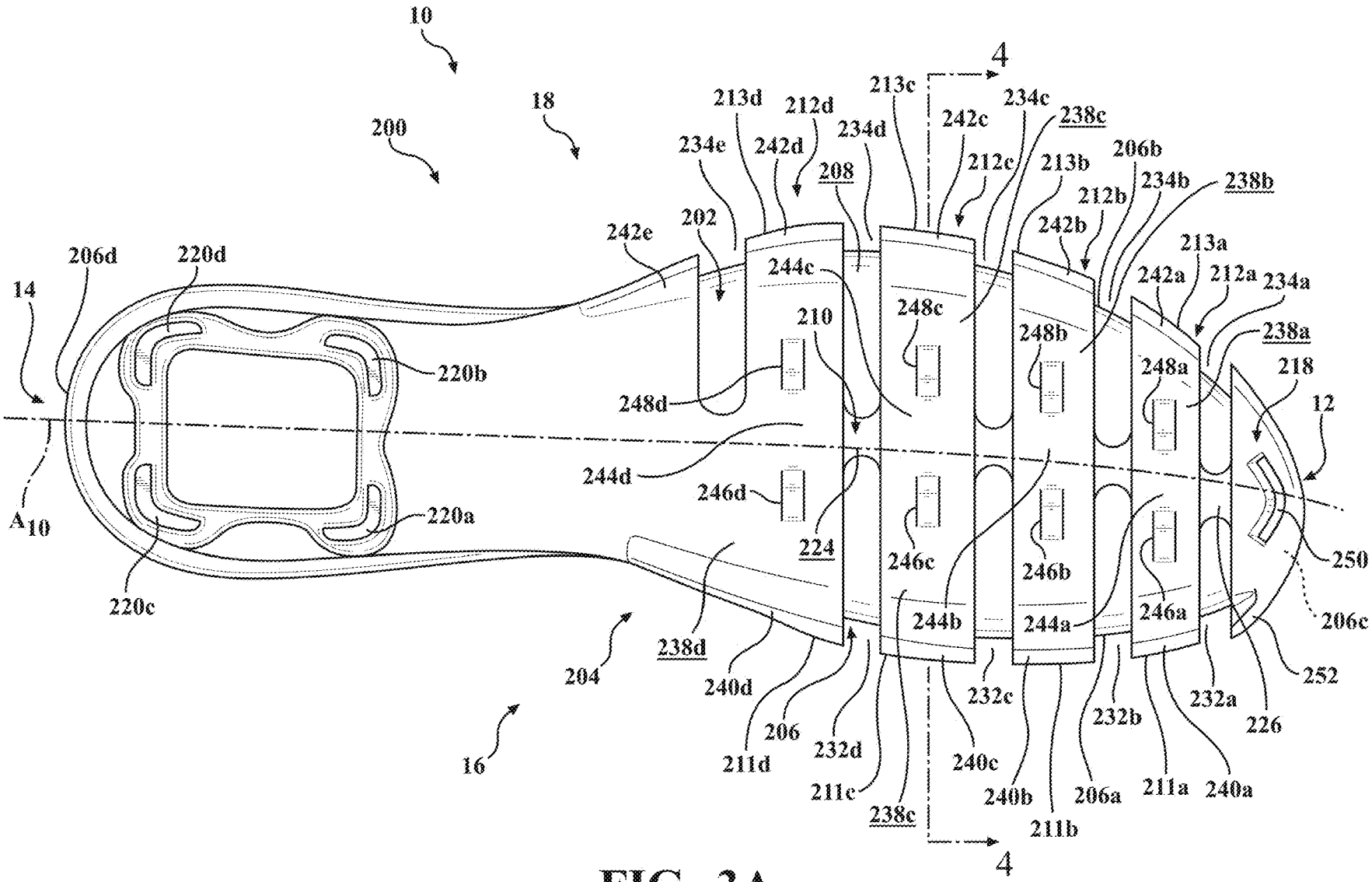
FIGS. 3A and 3B are bottom plan views of the article of footwear of FIG. 1.
Figure 3B:
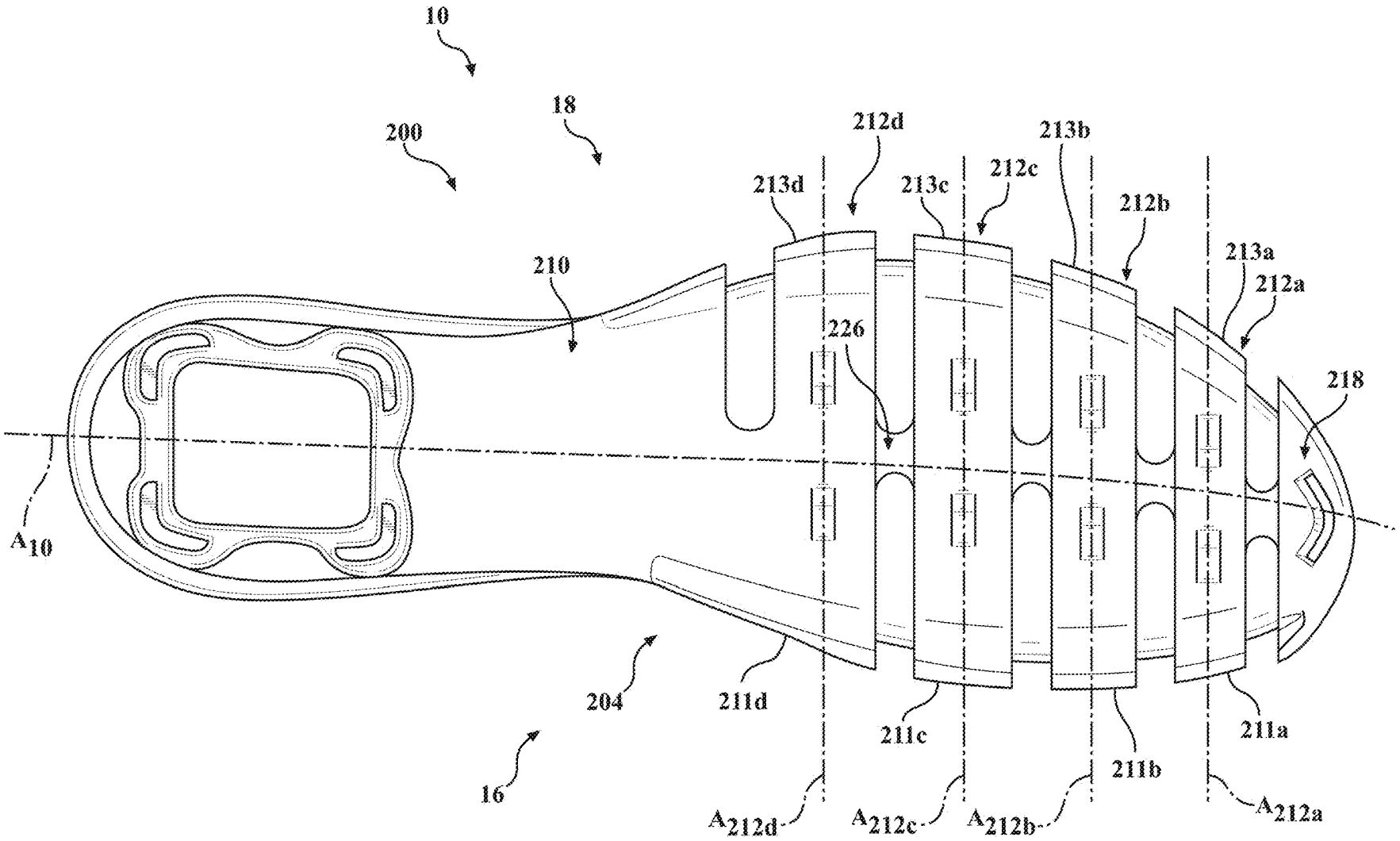

Referring to FIG. 1, an article of footwear 10 includes an upper 100 and a sole structure 200. The footwear 10 may further include an anterior end 12 associated with a forward-most point of the footwear, and a posterior end 14 corresponding to a rearward-most point of the footwear 10. As shown in FIGS. 3A and 3B, a longitudinal axis $A_{10}$ of the footwear 10 extends along a central portion of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18. The article of footwear 10 may be divided into one or more regions. The regions may include a forefoot region 20, a mid-foot region 22, and a heel region 24.

The upper 100 includes interior surfaces that define an interior void 102 configured to receive and secure a foot for support on sole structure 200. The upper 100 may be formed from one or more materials that are stitched or adhesively bonded together to form the interior void 102. Suitable materials of the upper may include, but are not limited to, mesh, textiles, foam, leather, and synthetic leather. The materials may be selected and located to impart properties of durability, air-permeability, wear-resistance, flexibility, and comfort.

In some examples, the upper 100 includes a strobel having a bottom surface opposing the sole structure 200 and an opposing top surface defining a footbed of the interior void 102. Stitching or adhesives may secure the strobel to the upper 100. The footbed may be contoured to conform to a profile of the bottom surface (e.g., plantar) of the foot. Optionally, the upper 100 may also incorporate additional layers such as an insole or sockliner that may be disposed upon the strobel and reside within the interior void 102 of the upper 100 to receive a plantar surface of the foot to enhance the comfort of the article of footwear 10.

An ankle opening 104 in the heel region 24 may provide access to the interior void 102. For example, the ankle opening 104 may receive a foot to secure the foot within the void 102 and to facilitate entry and removal of the foot to and from the interior void 102. In some examples, one or more fasteners 106 extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners 106. The fasteners 106 may include laces, straps, cords, hook-and-loop, or any other suitable type of fastener. The upper 100 may include a tongue portion 108 that extends between the interior void 102 and the fasteners 106.

Referring to FIGS. 1-3B, the sole structure 200 includes a midsole 202 secured to the upper 100 and an outsole 204 secured to the midsole 202. The midsole 202 may be formed of a resilient polymeric material, such as foam or rubber, to impart properties of cushioning, responsiveness, and energy distribution to the foot of the wearer. For example, the midsole 202 may be formed of foam materials providing greater cushioning and impact distribution, while the outsole 204 may be formed of a material having a greater stiffness in order to provide increased lateral stiffness to a peripheral region of the upper 100. The outsole 204 is formed of any suitable material, such as, for example, a foam, a plastic, a thermoplastic polyurethane, a polyvinyl chloride, etc.

The midsole 202 may include a peripheral edge 206 extending from the forefoot region 20 to the heel region 24 along each of the medial side 16 and the lateral side 18, and wrapping around each of the anterior end 12 and the posterior end 14. The peripheral edge 206 may be where the midsole 202 meets the upper 100 at a peripheral region of the article of footwear 10. In other implementations, the peripheral edge 206 is the outermost edge of the midsole 202 from the perspective of a bottom plan view of the article of footwear 10 (e.g., FIG. 3A). The peripheral edge 206 includes a medial edge 206*a* extending along the medial side 16, a lateral edge 206*b* extending along the lateral side 18, an anterior edge 206*c* wrapping around the anterior end 12, and a posterior edge 206*d* wrapping around the posterior end 14. The midsole 202 also includes a bottom surface 208 facing away from the upper 100.

Referring to FIGS. 1-4, the outsole 204 includes a chassis 210, a plurality of articulable lower ribs 212*a*-212*d*, a plurality of medial flex members 214*a*-214*d*, a plurality of lateral flex members 216*a*-216*d*, a toe plate 218, and a plurality of heel traction elements 220*a*-220*d*. Each of the components of the outsole 204 may be integrally formed with one another, formed separately and connected to one other in any suitable manner, such as, for example, stitching, welding, glue, mechanical fasteners, etc., or some combination of the two.

The chassis 210, also referred to as a bottom plate, extends from the anterior end 12 to the posterior end, and includes a top surface 222 and a bottom surface 224 formed on an opposite side of the chassis 210 from the top surface 222. The top surface 222 may be secured to the bottom surface 208 of the midsole 202 from the forefoot region 20 to the heel region 24. The bottom surface 224 of the chassis 210 faces away from the midsole 202 and toward the plurality of lower ribs 212*a*-212*d*. In the illustrated example, the chassis 210 extends continuously from the anterior end 12 to the posterior end 14. In other examples, the chassis 210 may be fragmentary, or may extend only along a portion of the article of footwear 10.

In the forefoot region, the chassis 210 includes a central spine 226 extending continuously from the forefoot region 20 to the mid-foot region 22. In some implementations, the central spine 226 extends along the longitudinal axis $A_{10}$. Accordingly, the central spine 226 extends along a central portion of the sole structure 200. In other implementations, the central spine 226 may be offset from or angled relative to the longitudinal axis $A_{10}$. The central spine 226 may extend between each of the plurality of lower ribs 212*a*-212*d* along the bottom surface 208 of the midsole 202. In other implementations, the central spine 226 may be spaced from the bottom surface 208 of the midsole 202.

The chassis 210 includes a plurality of flanges 228*a*-228*d*, 230*a*-230*d* projecting outward from opposite sides of the central spine 226. Particularly, the chassis 210 includes a plurality of medial flanges 228*a*-228*d* on the medial side 16 and a plurality of lateral flanges 230*a*-230*d* on the lateral side 18. The medial flanges 228*a*-228*d* extend from a first end attached to the central spine 226 to a distal end 229*a*-229*d* adjacent to the medial edge 206*a* of the upper 100. Likewise, the lateral flanges 230*a*-230*d* extend from a first end attached to the central spine 226 to a distal end 231*a*-231*d* adjacent to the lateral edge 206*b* of the upper 100. The distal ends 229*a*-229*d*, 231*a*-231*d* of the flanges 228*a*-228*d*, 230*a*-230*d* may wrap around and be secured to the respective medial and lateral edges 206*a*, 206*b* of the midsole 202. In some implementations, the medial flanges 228 and the lateral flanges 230 may extend and be secured to the upper 100.

Adjacent ones of the medial flanges 228*a*-228*d* are spaced apart from each other by a plurality of medial gaps 232*a*-232*d* on the medial side 16 such that the distal ends 229*a*-229*d* of the medial flanges 228*a*-228*d* are independent from each other. Likewise, adjacent ones of the lateral flanges 230*a*-230*d* are spaced apart from each other by a plurality of lateral gaps 234*a*-234*c* on the lateral side 18 such that the distal ends 231*a*-231*d* of the medial flanges 228*a*-228*d* are independent from each other. Accordingly, the medial flanges 228*a*-228*d* may independently flex about the central spine 226 on the medial side 16 and the lateral flanges 230*a*-230*d* may independently flex about the central spine 226 on the lateral side 18.

The medial gaps 232*a*-232*d* may extend from the medial edge 206*a* to the central spine 226 and the lateral gaps 234*a*-234*c* may extend from the lateral edge 206*b* to the central spine 226. Further, the medial gaps 232*a*-232*d* and the lateral gaps 234*a*-234*e* may expose the midsole 202 between two of the plurality of lower ribs 212*a*-212*d*. For example, the midsole 202 may be exposed such that it can be seen from the perspective of a bottom plan view of the article of footwear 10 (e.g., FIG. 3A). In some implementations, there may be more lateral gaps 234*a*-234*c* (e.g., one more lateral gap 232*e*) than there are medial gaps 232*a*-232*d*. In other implementations, there may be an equal number of lateral gaps and medial gaps or there may be more medial gaps than there are lateral gaps.

With continued reference to FIGS. 1-4, the plurality of lower ribs 212*a*-212*d* are arranged in series along the forefoot region 20 of the article of footwear 10. In the illustrated example, the plurality of lower ribs 212*a*-212*d* includes four lower ribs 212*a*-212*d*. In other implementations, there may be any suitable number of lower ribs 212*a*-212*d*. As best shown in FIG. 3B, each of the plurality of lower ribs 212*a*-212*d* extends continuously from a first distal end 211*a*-211*d* at the medial edge 206*a* to a second distal end 213*a*-213*d* at the lateral edge 206*b*. In other implementations, the plurality of lower ribs 212*a*-212*d* may extend beyond or protrude outwardly from the peripheral edge 206 of the midsole 202, or the plurality of lower ribs 212*a*-212*d* may be disposed within the peripheral edge 206 of the midsole 202. Each of the plurality of lower ribs 212*a*-212*d* extends transverse to the longitudinal axis $A_{10}$. In the illustrated example, each of the lower ribs 212*a*-212*d* extend from the medial edge 206*a* to the lateral edge 206*b* along a longitudinal axis $A_{212a}$-$A_{212a}$ that is substantially perpendicular to the longitudinal axis $A_{10}$ of the footwear 10. However, the lower ribs 212*a*-212*d* may extend in any suitable direction transverse to the longitudinal axis $A_{10}$. The size, shape, orientation, etc., of each of the plurality of lower ribs 212*a*-212*d* may be the same or different as the other of the plurality of lower ribs 212*a*-212*d*.

Each of the plurality of lower ribs 212*a*-212*d* includes an inner surface 236*a*-236*d* and an outer surface 238*a*-238*d* formed on an opposite side of the lower rib 212*a*-212*d* from the inner surface 236*a*-236*d*. The inner surface 236*a*-236*d* faces and is spaced from the bottom surface 224 of the chassis 210. The outer surface 238*a*-238*d* is configured to engage a ground surface. In some implementations, the outer surface 238*d* of the posterior-most forefoot lower rib 212*d* extends into the heel region 24 and converges with the bottom surface 224 of the chassis 210. Accordingly an anterior-facing end of the posterior-most lower rib 212*d* may be spaced apart from the chassis 210, while a posterior-facing end converges with and terminates at the chassis 210.

Each of the plurality of lower ribs 212*a*-212*d* includes a medial traction element 240*a*-240*d* on the medial side 16 and a lateral traction element 242*a*-242*e* on the lateral side 18. The medial traction elements 240*a*-240*d* may be disposed at the first distal end 211*a*-211*d* of each lower rib 212*a*-212*d* (e.g., near the medial edge 206*a*), and the lateral traction elements 242*a*-242*e* may be disposed at opposite distal ends 213*a*-213*d* of each lower rib 212*a*-212*d* (e.g., near the lateral edge 206*b*). The medial traction elements 240*a*-240*d* and the lateral traction elements 242*a*-22*d* are disposed on the outer surface 238*a*-238*d* of each of the lower ribs 212*a*-212*d*. The medial traction elements 240*a*-240*d* and the lateral traction elements 242*a*-242*d* are configured to engage a ground surface and provide increased grip, friction, and/or traction between the article of footwear 10 and the ground surface.

Each of the plurality of lower ribs 212*a*-212*d* includes a central portion 244*a*-244*d* disposed between the medial traction elements 240*a*-240*d* and the lateral traction elements 242*a*-242*d*. In some implementations, the central portions 244*a*-244*d* may be aligned with the central spine 226. The central portions 244*a*-244*d* may be spaced from the chassis 210 and the midsole 202. In some implementations, the central portions 244*a*-244*d* may be spaced from the chassis 210 by a void. In other implementations, the central portions 244*a*-244*d* may be spaced from the chassis 210 by any suitable element, such as, for example, a foam member, a fluid-filled chamber, etc. Accordingly, the lower ribs 212*a*-212*d* may be described as being floating ribs 212*a*-212*d*, wherein an entirety of one or more of the lower ribs 212*a*-212*d* is spaced apart from the bottom surface 224 of the chassis 210, such that the lower rib 212*a*-212*d* is able to move independently from the chassis 210.

Figure 4:
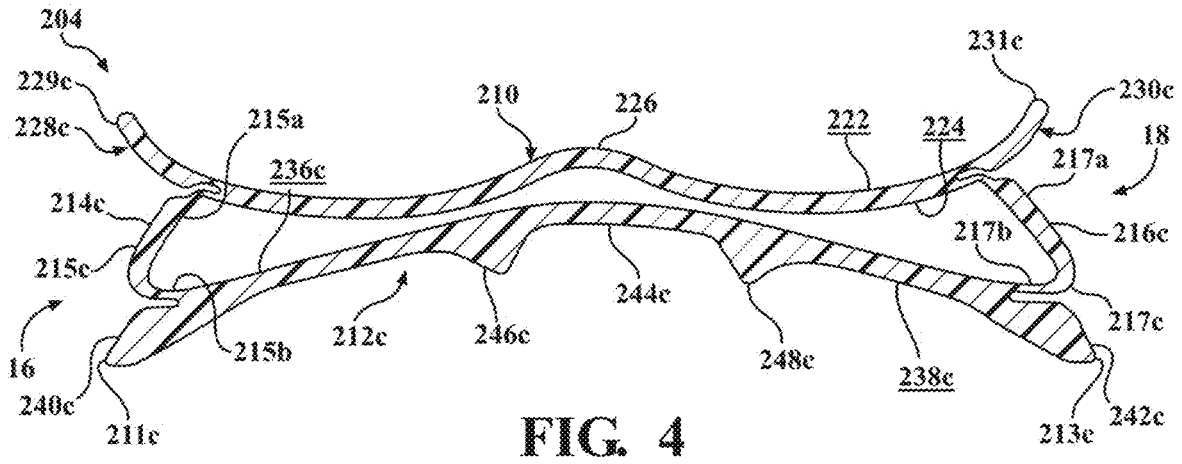
FIG. 4 is a cross-sectional view of the sole structure of FIG. 1, taken along line 4-4 in FIG. 3A.

In a relaxed state, each of the lower ribs 212*a*-212*d* is arcuate relative to the chassis 210 and the midsole 202. For example, as best shown in FIG. 4, a distance between the inner surface 236*a*-236*d* of each lower rib 212*a*-212*d* and the bottom surface 224 of the chassis 210 is less at the central portion 244*a*-244*d* than at the portions of the lower ribs 212*a*-212*d* located near the medial edge 206*a* and the lateral edge 206*b*, such that the inner surface 236*a*-236*d* of each of the lower ribs 212*a*-212*d* is convex relative to the chassis and the outer surface 238*a*-238*d* of each of the lower ribs 212*a*-212*d* is concave relative to the chassis 210. For example, each of the lower ribs 212*a*-212*d* extends along an arcuate path from a portion of each lower rib 212*a*-212*d* located near the medial edge 206*a* to a portion of each lower rib 212*a*-212*d* located near the lateral edge 206*b*. In some implementations, the outer surfaces 238*a*-238*d* of the lower ribs 212*a*-212*d* are arcuate relative to the bottom surface 224 of the chassis 210 and the midsole 202. Each of the lower ribs 212*a*-212*d* may include a central medial traction element 246*a*-246*d* and a central lateral traction element 248*a*-248*d* on the outer surface 238*a*-238*d* at the central portion 244*a*-244*d*. The central medial traction elements 246*a*-246*d* and the central lateral traction elements 248*a*-248*d* are configured to engage a ground surface and provide increased grip, friction, and/or traction between the article of footwear 10 and the ground surface.

Figure 2A:
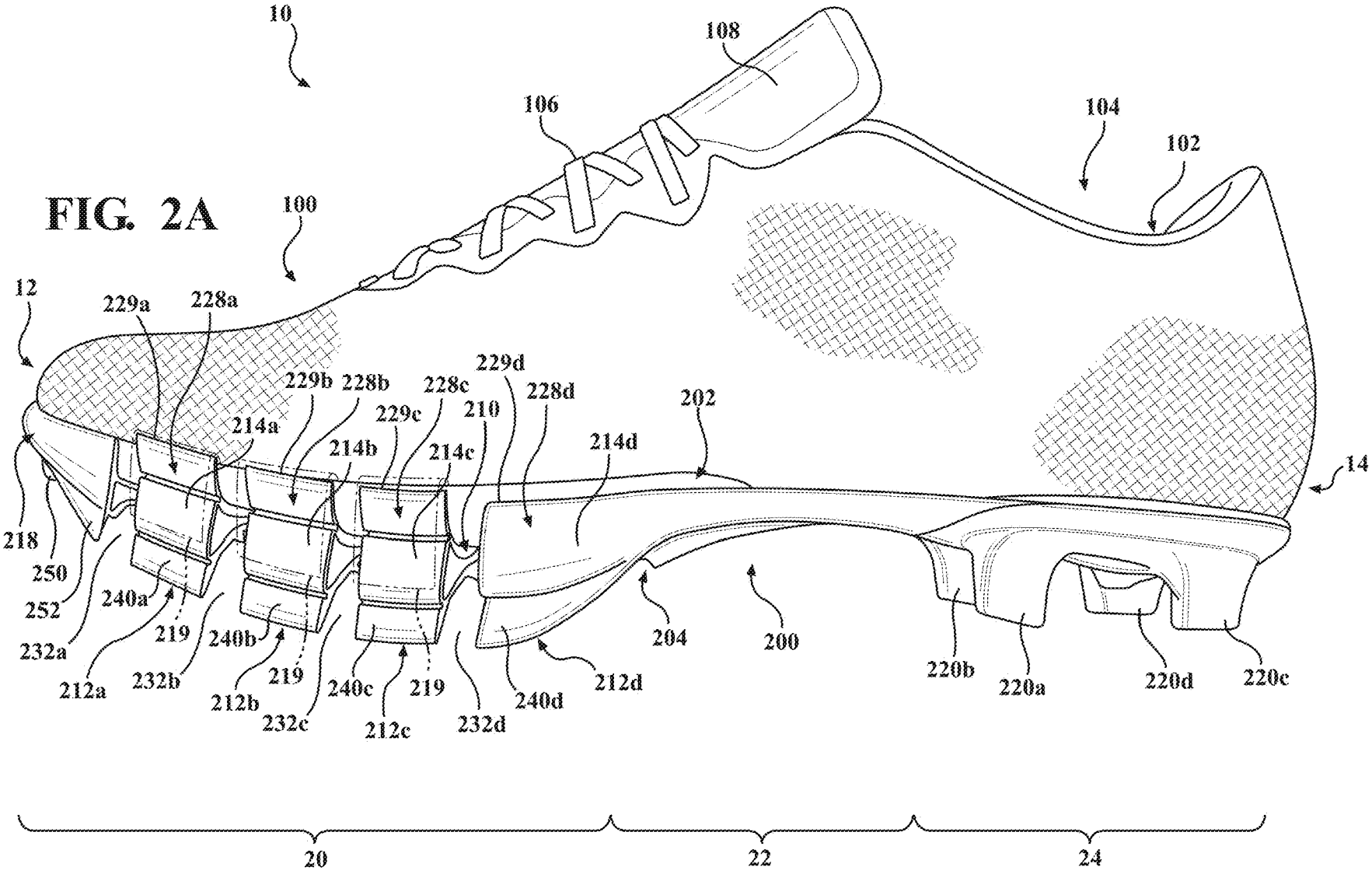
FIG. 2A is a medial side elevation view of the article of footwear of FIG. 1.
Figure 2B:
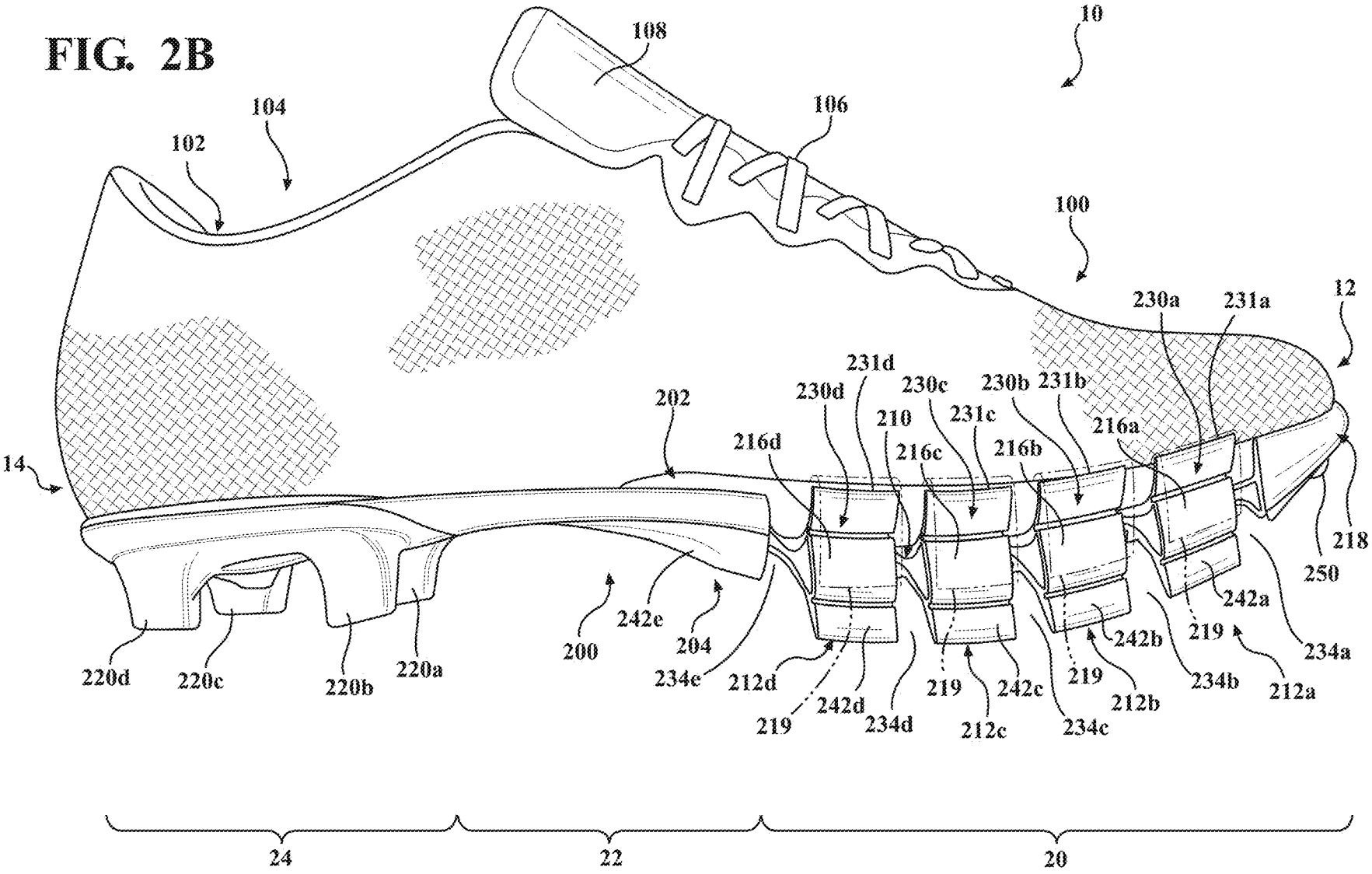
FIG. 2B is a lateral side elevation view of the article of footwear of FIG. 1.

Referring to FIGS. 2A and 4, the plurality of medial flex members 214*a*-214*d* extend from the chassis 210 to the lower ribs 212*a*-212*d* near the medial edge 206*a* such that the medial flex members 214*a*-214*d* are disposed at or close to the medial edge 206*a*. For example, the plurality of medial flex members 214*a*-214*d* are disposed between the midsole 202 and the lower ribs 212*a*-212*d* near the medial edge 206*a*. As shown in FIGS. 2B and 4, the plurality of lateral flex members 216*a*-216*d* extend from the chassis 210 to the lower ribs 212*a*-212*d* near the lateral edge 206*b* such that the lateral flex members 216*a*-216*d* are disposed at or close to the lateral edge 206*b*. For example, the plurality of lateral flex members 216*a*-216*d* are disposed between the midsole 202 and the lower ribs 212*a*-212*d* near the lateral edge 206*b*. The medial flex members 214*a*-214*d* and the lateral flex members 216*a*-216*d* may be formed of a flexible, resilient material, such as a polymeric foam or rubber, as will be described in greater detail below.

The medial flex members 214*a*-214*d* and the lateral flex members 216*a*-216*d* are configured to allow the lower ribs 212*a*-212*d* to articulate relative to the midsole 202 in response to a force, as described in greater detail below. For example, the medial flex members 214*a*-214*d* and the lateral flex members 216*a*-216*d* may facilitate movement of the lower ribs 212*a*-212*d* toward and away from the midsole 202. Although not illustrated in cross-section, the remaining lower ribs 212*a*, 212*b*, 212*d* are connected to the chassis 210 in a similar fashion as the illustrated lower rib 212*c*, and will not be separately described.

Referring now to FIG. 4, a cross-section showing an example interface between the chassis 210 and respective ones of the lower ribs 212*c*, medial flex members 214*c*, and lateral flex members 216*c* is provided. In the illustrated example, the medial flex members 214*a*-214*d* and the lateral flex members 216*a*-216*d* cooperate with the chassis 210 and respective ones of the lower ribs 212*a*-212*d* to form a plurality of four-bar linkages. Here, the medial flex member

214*c* includes an upper leg 215*a* flexibly attached to the distal end 229*c* of the medial flange 228*c* and a lower leg 215*b* flexibly attached to the first distal end 211*c* of the lower rib 212*c*. Similarly, the lateral flex member 216*c* includes an upper leg 217*a* flexibly attached to the distal end 231*c* of the lateral flange 230*c*, and a lower leg 217*b* attached to the second distal end 213*c* of the lower rib 212*c*. As shown, the lower legs 215*b*, 217*b* may be integrally formed with the lower rib 212*c*. Accordingly, the flexible attachments provide four links between the lower rib 212*c* and the chassis 210, thereby allowing the lower rib 212*c* to move about the flex members 214*c*, 216*c* relative to the chassis 210.

In some examples, the flex members 214*c*, 216*c* each include a flexible intermediate portion 215*c*, 217*c* disposed between and connecting the upper leg 215*a*, 217*a* and the lower leg 215*b*, 217*b*, respectively. Thus, the intermediate portion 215*c*, 217*c* forms a living hinge between the upper leg 215*a*, 217*a* and the lower leg 215*b*, 217*b*, and allows each of the flex members 214*c*, 216*c* to collapse upon itself. Accordingly, in addition to the lateral movement facilitated by the flexible connections between the flex members 214*c*, 216*c* and each of the chassis 210 and lower rib 212*c*, the flex members 214*c*, 216*c* also facilitate relative vertical and compound (i.e. vertical and lateral) movement between the lower rib 212*c* and the chassis 210.

The medial flex members 214*a*-214*d* and the lateral flex members 216*a*-216*d* may flare out or be angled relative to the chassis 210 and the lower ribs 212*a*-212*d*. For example, the medial flex members 214*a*-214*d* and the lateral flex members 216*a*-216*d* may be located closer to the longitudinal axis $A_{10}$ where the medial flex members 214*a*-214*d* and the lateral flex members 216*a*-216*d* attach to the chassis 210 than where the medial flex members 214*a*-214*d* and the lateral flex members 216*a*-216*d* attach to the lower ribs 212*a*-212*d*. As another example, the medial flex members 214*a*-214*d* and the lateral flex members 216*a*-216*d* may be located closer to the longitudinal axis $A_{10}$ where the medial flex members 214*a*-214*d* and the lateral flex members 216*a*-216*d* attach to the lower ribs 212*a*-212*d* than where the medial flex members 214*a*-214*d* and the lateral flex members 216*a*-216*d* attach to the chassis 210.

Referring to FIGS. 2A and 2B, the outsole 204 may include a plurality of resilient covers or shrouds 219 (phantom line) extending from the upper 100 toward the medial traction elements 240*a*-240*d* and the lateral traction elements 242*a*-242*d*. The covers 219 are shown as extending over the flanges 228*a*-228*c*, 230*a*-230*d* and terminating at portions of the medial flex members 214*a*-214*c* and the lateral flex members 216*a*-216*d*. The covers 219 may be formed from any suitable material, such as plastic, rubber, fabric, etc., and may be secured to the upper 100 and the lower ribs 212*a*-212*d* in any suitable manner, such as via stitching, glue, welding, etc.

Referring to FIGS. 1-3B, the outsole 204 may include the toe plate 218 disposed near the anterior end 12 of the article of footwear 10. The toe plate 218 may be similar to the lower ribs 212*a*-212*d*, such that the toe plate 218 is configured to float or articulate relative to the midsole 202, but may extend from the medial edge 206*a* to the lateral edge 206*b*, wrapping around the anterior edge 206*c*. In some configurations, the toe plate 218 includes a portion spaced from the chassis 210 and the midsole 202 adjacent to the peripheral edge 206. In other configurations, at least a portion of the toe plate 218 contacts the chassis 210 and/or is integrally formed with the chassis 210. The toe plate 218 includes an anterior traction element 250 and a medial traction element 252. The anterior traction element 250 may be similar to the central medial traction elements 246 and the central lateral traction elements 248. The anterior traction element 250 may have a generally V-shaped configuration with the junction of the "V" pointing toward the anterior end 12. The medial traction element 252 may be similar to the medial traction elements 240*a*-240*d*.

With continued reference to FIGS. 1-3B, the outsole 204 may include the heel traction elements 220*a*-220*d* in the heel region 24. The heel traction elements 220*a*-220*d* may extend away from the midsole 202 and may be configured to engage a ground surface and provide increased grip, friction, and/or traction between the article of footwear 10 and the ground surface. In some implementations, there may be four heel traction elements 220*a*-220*d*. In other implementations, there may be any suitable number of heel traction elements 220*a*-220*d*. Additionally, each of the heel traction elements 220*a*-220*d* may have the same size, shape, and orientation as the other of the heel traction elements 220*a*-220*d* or each of the heel traction elements 220*a*-220*d* may have different sizes, shapes, and/or orientations than the other of the heel traction elements 220*a*-220*d*.

Figure 5:
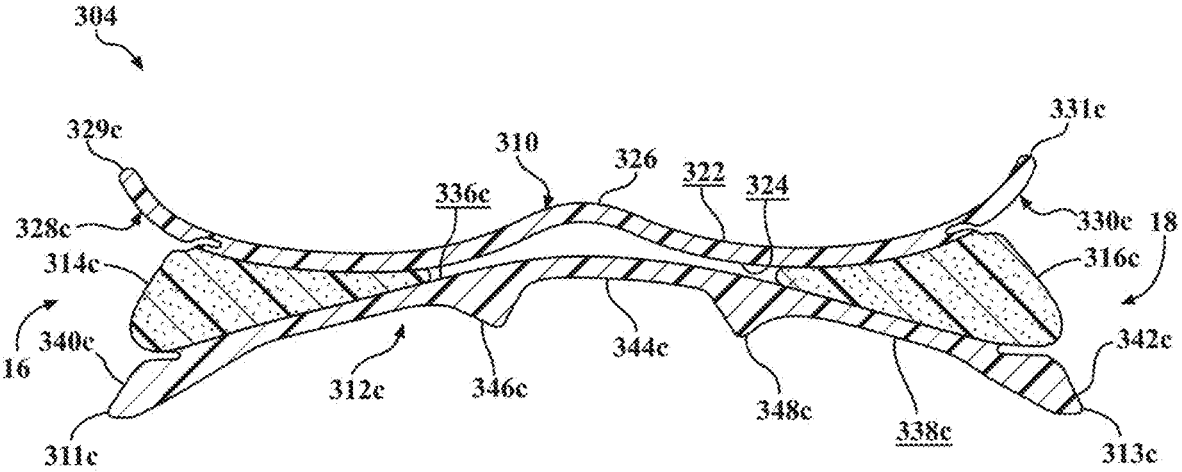
FIG. 5 is a cross-sectional view of another example sole structure of an article of footwear in accordance with principles of the present disclosure.

Referring to FIG. 5, another outsole 304 for use with an article of footwear (e.g., article of footwear 10) is shown. The structure and function of the outsole 304 may be substantially similar to that of the outsole 204 apart from any exceptions described below and/or shown in the Figures. Accordingly, the structure and/or function of similar features will not be described again in detail. In addition, like reference numerals are used hereinafter and in the drawings to identify like features, with the reference numerals beginning with "3" instead of "2" (e.g., chassis 310 is similar to chassis 210).

The outsole 304 includes a plurality of medial flex members 314 and a plurality of lateral flex members 316. The medial flex members 314 and the lateral flex members 316 may be foam members formed from one or more resilient polymeric materials such as, for example, one or more elastomers (e.g., thermoplastic elastomers (TPE)). The one or more polymeric materials may include aliphatic polymers, aromatic polymers, or mixtures of both; and may include homopolymers, copolymers (including terpolymers), or mixtures of both.

Figure 6:
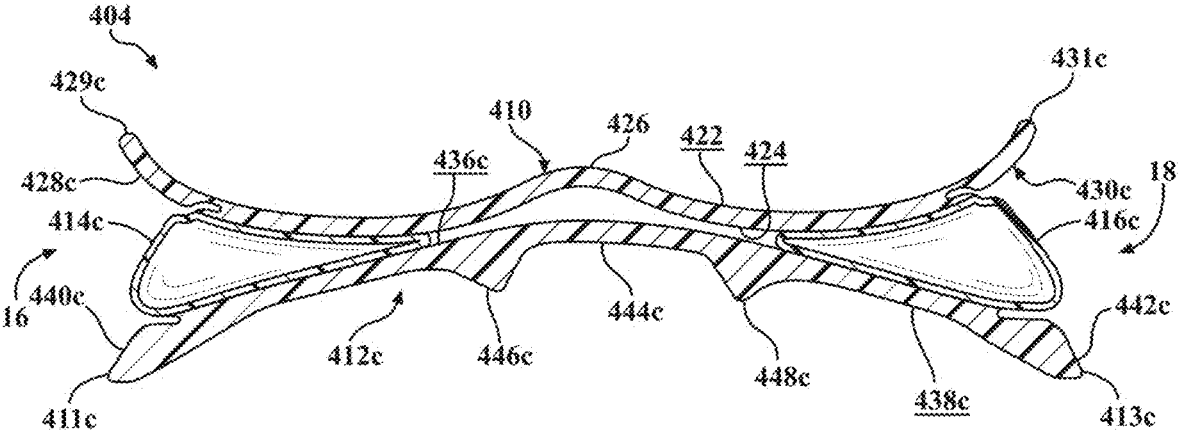
FIG. 6 is a cross-sectional view of another sole structure of an article of footwear in accordance with principles of the present disclosure.

Referring to FIG. 6, another outsole 404 for use with an article of footwear (e.g., article of footwear 10) is shown. The structure and function of the outsole 404 may be substantially similar to that of the outsole 204 apart from any exceptions described below and/or shown in the Figures. Accordingly, the structure and/or function of similar features will not be described again in detail. In addition, like reference numerals are used hereinafter and in the drawings to identify like features, with the reference numerals beginning with "4" instead of "2" (e.g., chassis 410 is similar to chassis 210).

The outsole 404 includes a plurality of medial flex members 414 and a plurality of lateral flex members 416. The medial flex members 414 and the lateral flex members 416 may be fluid-filled chambers (e.g., barrier layers joined to each other at discrete locations to define a fluid-filled chamber). The barrier layers can be produced from an elastomeric material that includes one or more thermoplastic polymers and/or one or more cross-linkable polymers. In one configuration, the elastomeric material can include one or more thermoplastic elastomeric materials, such as one or more thermoplastic polyurethane (TPU) copolymers, one or more ethylene-vinyl alcohol (EVOH) copolymers, and the like.

Figure 7:
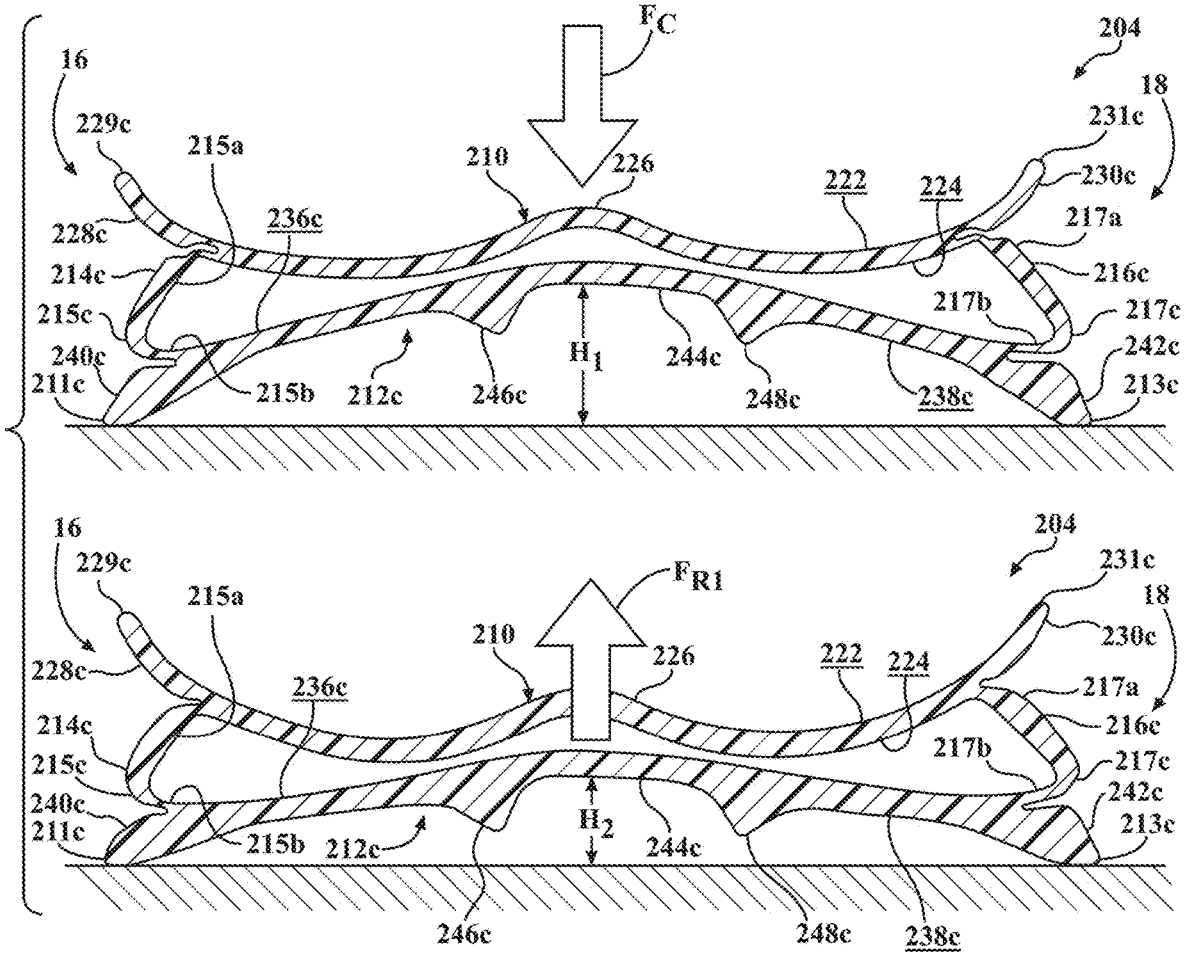
FIG. 7 is a dynamic view of the cross-section shown in FIG. 4, showing a reaction of the sole structure under application of a vertical load.

Referring to FIG. 7, a compressive force $F_C$ may be directed upon the outsole 204, e.g., the top surface 222 of the chassis 210, in a generally vertical direction. In a relaxed state, before application of the compressive force $F_C$, the outsole 204 may have a first height $H_1$ from a ground surface to the outer surfaces 238*a*-238*d* of the lower ribs 212*a*-212*d* near the central portion 244*a*-244*c*. In a compressed state, after application of the compressive force $F_C$, the outsole 204 may have a second height $H_2$ from the ground surface to the outer surfaces 238*a*-238*d* of the lower ribs 212*a*-212*d* near the central portion 244*a*-244*d*. As shown in FIG. 7, the second height $H_2$ may be less than the first height $H_1$. That is, the outsole 204, including the chassis 210 and the lower ribs 212*a*-212*d*, may compress toward the ground surface in response to the compressive force $F_C$. The compressive force $F_C$ may correspond to a user planting his or her foot or putting weight upon the foot in preparation of pushing off of the foot during activities such as running, jumping, etc. In response to the compressive force $F_C$, the lower ribs 212*a*-212*d* may flex toward the chassis 210. If the compressive force Fe is great enough, the lower ribs 212*a*-212*d* may flex until they contact the chassis 210. For example, the medial flex members 214*a*-214*d* and the lateral flex members 216*a*-216*d* may flare out to a position further than a resting position (shown in FIG. 4), causing the lower ribs 212*a*-212*d* to reduce the degree to which the lower ribs 212*a*-212*d* are curved (e.g., the arcuate configuration of the lower ribs 212*a*-212*d* may become more shallow). When the compressive force $F_C$ is eliminated (e.g., when a user lifts his or her foot), the outsole 204 exhibits a first reaction force $F_{R1}$ parallel and opposite to the compressive force $F_C$. The first reaction force $F_{R1}$ may flex the medial flex members 214*a*-214*d*, the lateral flex members 216*a*-216*d*, and the lower ribs 212*a*-212*d* toward the resting position. In some implementations, the first reaction force $F_{R1}$ may flex the medial flex members 214*a*-214*d*, the lateral flex members 216*a*-216*d*, and the lower ribs 212*a*-212*d* briefly past the resting position and then the medial flex members 214*a*-214*d*, the lateral flex members 216*a*-216*d*, and the lower ribs 212*a*-212*d* may return to the resting position.

Figure 8:
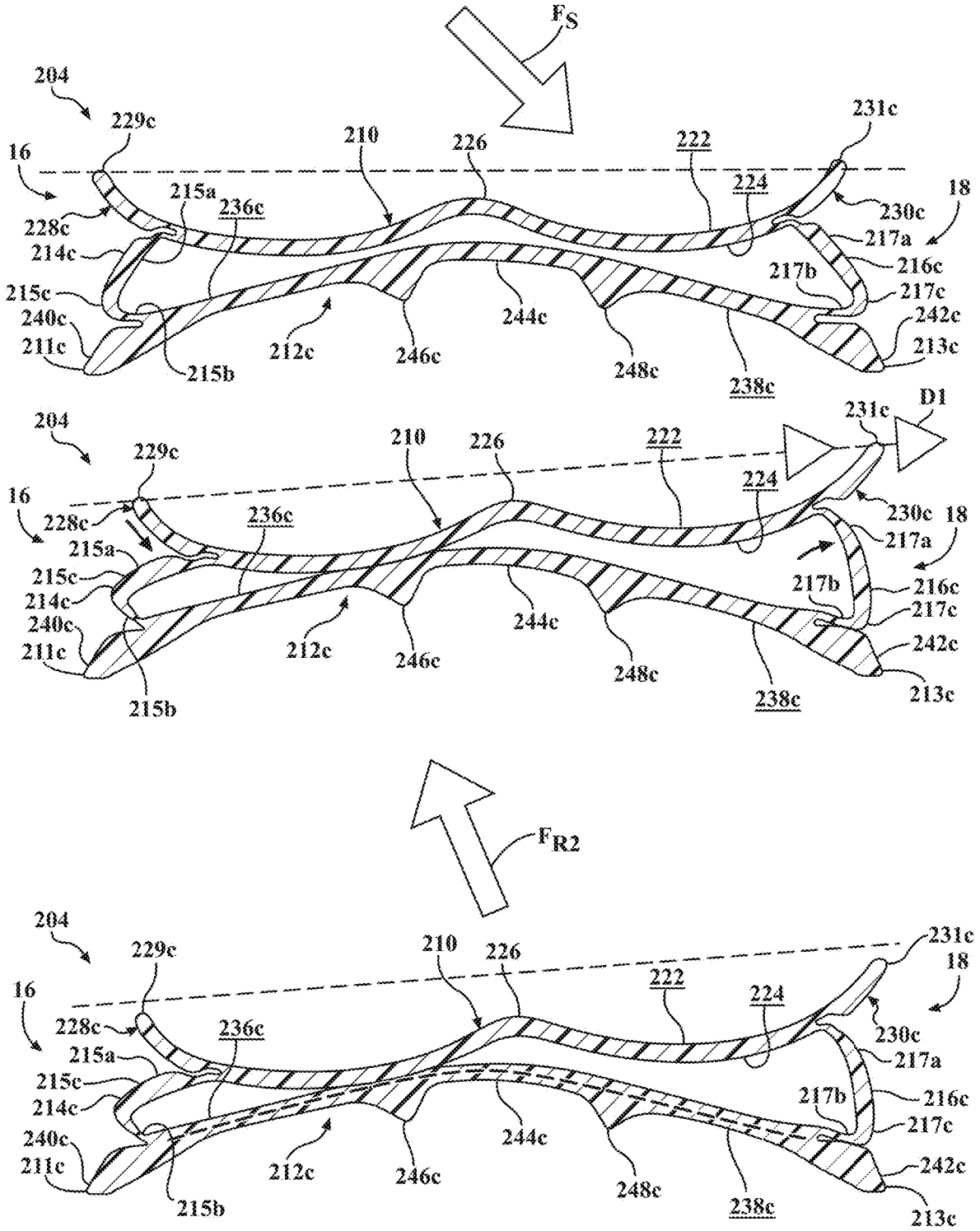
FIG. 8 is a dynamic view of the cross-section shown in FIG. 4, showing a reaction of the sole structure under application of compound or lateral loads.

Referring to FIG. 8, a shear force $F_S$ may be directed upon the outsole 204 (e.g., the top surface 222 of the chassis 210) in a generally angled direction toward the lateral side 18. The shear force $F_S$ may correspond to a user laterally planting his or her foot or laterally putting weight upon the foot in preparation of pushing off of the foot during activities such as running, jumping, cutting, turning, etc. In response to the shear force $F_S$, the lower ribs 212*a*-212*d* may flex toward the chassis 210 and shift toward the lateral side 18. If the shear force $F_S$ is great enough, the lower ribs 212*a*-212*d* may flex until they contact the chassis 210. For example, the medial flex members 214*a*-214*d* may flare out to a position further than the resting position (shown in FIG. 4), causing the lower ribs 212*a*-212*d* to reduce the degree to which the lower ribs 212*a*-212*d* are curved (e.g., the arcuate configuration of the lower ribs 212*a*-212*d* may become more shallow). In some implementations, the lateral flex members 216*a*-216*d* may flex toward a position closer to the longitudinal axis $A_{10}$ than the resting position to facilitate movement of the chassis 210 in a direction Di toward the lateral side 18. When the shear force $F_S$ is eliminated (e.g., when a user lifts his or her foot), the outsole 204 exhibits a second reaction force $F_{R2}$ transverse to the shear force $F_S$. The second reaction force $F_{R2}$ may flex the medial flex members 214*a*-214*d*, the lateral flex members 216*a*-216*d*, and the lower ribs 212*a*-212*d* toward the resting position. In some implementations, the second reaction force $F_{R2}$ may flex the medial flex members 214*a*-214*d*, the lateral flex members 216*a*-216*d*, and the lower ribs 212*a*-212*d* briefly past the resting position and then the medial flex members 214*a*-214*d*, the lateral flex members 216*a*-216*d*, and the lower ribs 212*a*-212*d* may return to the resting position.

In some implementations, as a user plants his or her foot or performs a cutting movement, one distal end 211*a*-211*d*, 213*a*-213*d* of the lower ribs 212*a*-212*d* (e.g., on the lateral side 18) flexes toward the chassis 210 and the other distal end 211*a*-211*d*, 213*a*-213*d* of the lower ribs 212*a*-212*d* (e.g., on the medial side 16) flexes away from the chassis 210. Upon a user pushing off, the lower ribs 212*a*-212*d* return to the resting position, resulting in a spring-like reaction, which may provide added bounce and power to the user. Because each of the lower ribs 212*a*-212*d* is independently attached to the midsole 202 via the respective medial flex members 214*a*-214*d* and the lateral flex members 216*a*-216*d*, each of the lower ribs 212*a*-212*d* may move independently relative to the midsole 202 and may flex to different degrees relative to the midsole 202 when subjected to a load. For example, when the user plants the forefoot at a compound angle relative to the ground surface (i.e., the forefoot is angled in both the lateral and longitudinal directions), the lower ribs 212*a*-212*d* may be subjected to different forces $F_C$, $F_S$, thereby causing one or more of the lower ribs 212*a*-212*d* to be angled and compressed differently from another one of the lower ribs 212*a*-212*d*. This independent movement allows the traction elements 240*a*-240*d*, 242*a*-242*d*, 246*a*-246*d*, 248*a*-248*d* on each of the ribs 212*a*-212*d* to remain engaged with the ground surface, thereby improving traction and flexibility over conventional sole structures.

The following Clauses provide an exemplary configuration for an article of footwear described above.

Clause 1: A sole structure for an article of footwear, the sole structure comprising a midsole having a medial edge and a lateral edge, a first lower rib extending from the medial edge to the lateral edge of the midsole, the first lower rib including a portion spaced from the midsole between the medial edge and the lateral edge, a medial flex member disposed between the midsole and the first lower rib near the medial edge, and a lateral flex member disposed between the midsole and the first lower rib near the lateral edge, the medial flex member and the lateral flex member configured to flex the first lower rib relative to the midsole in response to a force of a predetermined magnitude.

Clause 2: The sole structure of Clause 1, further comprising a second lower rib extending from the medial edge to the lateral edge of the midsole, the second lower rib including a portion spaced from the midsole between the medial edge and the lateral edge, a second medial flex member disposed between the midsole and the second lower rib near the medial edge, and a second lateral flex member disposed between the midsole and the second lower rib near the lateral edge, the second medial flex member and the second lateral flex member configured to flex the second lower rib relative to the midsole in response to a force of a predetermined magnitude.

Clause 3: The sole structure of Clause 2, wherein the second lower rib is spaced from the first lower rib along an axis extending from a heel region to a forefoot region of the article of footwear.

Clause 4: The sole structure of Clause 2, wherein the first lower rib and the second lower rib are disposed in a forefoot region of the article of footwear.

Clause 5: The sole structure of Clause 1, wherein the first lower rib is disposed in a forefoot region of the article of footwear.

Clause 6: The sole structure of Clause 1, wherein the first lower rib is concave relative to the midsole.

Clause 7: The sole structure of Clause 1, further comprising a bottom plate secured to the midsole.

Clause 8: The sole structure of Clause 7, wherein the first lower rib includes an inner surface and an outer surface opposite the inner surface, the inner surface facing and being spaced from the bottom plate and the outer surface being configured to engage a ground surface.

Clause 9: The sole structure of Clause 7, further comprising a second lower rib spaced from the first lower rib along an axis extending from a heel region to a forefoot region of the article of footwear, wherein the bottom plate defines a gap exposing the midsole between the first lower rib and the second lower rib.

Clause 10: The sole structure of Clause 1, wherein the medial flex member and the lateral flex member are one of foam members or fluid-filled chambers.

Clause 11: A sole structure for an article of footwear, the sole structure comprising a midsole having a medial edge and a lateral edge, a bottom plate secured to the midsole and extending from the medial edge to the lateral edge of the midsole, a first lower rib extending from the medial edge to the lateral edge of the midsole, the first lower rib including a portion spaced from the bottom plate between the medial edge and the lateral edge, a medial flex member extending from the bottom plate to the first lower rib near the medial edge, and a lateral flex member extending from the bottom plate to the first lower rib near the lateral edge, the medial flex member and the lateral flex member configured to flex the first lower rib relative to the bottom plate in response to a force of a predetermined magnitude.

Clause 12: The sole structure of Clause 11, further comprising, a second lower rib extending from the medial edge to the lateral edge of the midsole, the second lower rib including a portion spaced from the bottom plate between the medial edge and the lateral edge, a second medial flex member extending from the bottom plate to the second lower rib near the medial edge, and a second lateral flex member extending from the bottom plate to the second lower rib near the lateral edge, the second medial flex member and the second lateral flex member configured to flex the second lower rib relative to the bottom plate in response to a force of a predetermined magnitude.

Clause 13: The sole structure of Clause 12, wherein the second lower rib is spaced from the first lower rib along an axis extending from a heel region to a forefoot region of the article of footwear.

Clause 14: The sole structure of Clause 12, wherein the first lower rib and the second lower rib are disposed in a forefoot region of the article of footwear.

Clause 15: The sole structure of Clause 12, wherein the bottom plate defines a gap exposing the midsole between the first lower rib and the second lower rib.

Clause 16: The sole structure of Clause 11, wherein the bottom plate defines a central spine along an axis extending from a heel region to a forefoot region of the article of footwear.

Clause 17: The sole structure of Clause 11, wherein the first lower rib is disposed in a forefoot region of the article of footwear.

Clause 18: The sole structure of Clause 11, wherein the first lower rib is convex relative to the bottom plate.

Clause 19: The sole structure of Clause 11, wherein the first lower rib includes an inner surface and an outer surface opposite the inner surface, the inner surface facing and being spaced from the bottom plate and the outer surface being configured to engage a ground surface.

Clause 20: The sole structure of Clause 11, wherein the medial flex member and the lateral flex member are one of foam members or fluid-filled chambers.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear, comprising:

a midsole having a medial edge and a lateral edge; and an outsole coupled to the midsole, the outsole including:

a first lower rib extending at least from the medial edge of the midsole to the lateral edge of the midsole;

a medial linking member coupled only to the first lower rib and an uppermost portion of the outsole, the medial linking member including a first upper leg flexibly attached to the uppermost portion of the outsole and a first lower leg flexibly attached to the first lower rib; and a lateral linking member coupled only to the first lower rib and the uppermost portion of the outsole, the lateral linking member including a second upper leg flexibly attached to the uppermost portion of the outsole and a second lower leg flexibly attached to the first lower rib, wherein an entirety of the first lower rib is spaced apart from the uppermost portion of the outsole by only the medial and lateral linking members.

2. The article of footwear of claim 1, wherein the medial linking member and the lateral linking member are configured to flex the first lower rib between a first state and a second state that is compressed relative to the midsole and the first state.

3. The article of footwear of claim 1, wherein the medial linking member and the lateral linking member are one of foam members or fluid-filled chambers.

4. The article of footwear of claim 1, wherein the first lower rib is disposed on a forefoot region of the article of footwear.

5. The article of footwear of claim 1, wherein the outsole further includes a second lower rib extending from the medial edge of the midsole to the lateral edge of the midsole, wherein an entirety of the second lower rib is spaced apart from the uppermost portion of the outsole by only two linking members.

6. The article of footwear of claim 5, wherein the second lower rib is spaced apart from the first lower rib along an axis extending from a heel region of the article of footwear to a forefoot region of the article of footwear.

7. The article of footwear of claim 6, wherein both the first lower rib and the second lower rib are disposed on a forefoot region of the article of footwear.

8. The article of footwear of claim 7, wherein the outsole further includes a spine coupled to both the first lower rib and the second lower rib.

9. The article of footwear of claim 8, wherein the spine is included in the uppermost portion of the outsole.

10. An article of footwear, comprising:

a midsole having a medial edge and a lateral edge; and an outsole coupled to the midsole and including:

a first lower rib extending from the medial edge of the midsole to the lateral edge of the midsole, wherein an entirety of the first lower rib is spaced apart from an upper portion of the outsole by linking members disposed only near the medial edge or the lateral edge of the midsole;

a second lower rib extending from the medial edge of the midsole to the lateral edge of the midsole, wherein an entirety of the second lower rib is spaced apart from the upper portion of the outsole by linking members disposed only near the medial edge or the lateral edge of the midsole; and a spine coupled to both the first lower rib and the second lower rib.

11. The article of footwear of claim 10, wherein the spine is included in the upper portion of the outsole.

12. The article of footwear of claim 10, wherein the second lower rib is spaced apart from the first lower rib along an axis extending from a heel region of the article of footwear to a forefoot region of the article of footwear.

13. The article of footwear of claim 10, wherein both the first lower rib and the second lower rib are disposed on a forefoot region of the article of footwear.

14. The article of footwear of claim 10, wherein:

the midsole further includes an anterior edge; and the outsole further includes a toe plate coupled to the spine and extending from the medial edge of the midsole to the lateral edge of the midsole and around an entirety of the anterior edge of the midsole.

15. An article of footwear, comprising:

a midsole having a medial edge, a lateral edge, and an anterior edge; and an outsole coupled to the midsole and including:

a first lower rib extending from the medial edge of the midsole to the lateral edge of the midsole, wherein an entirety of the first lower rib is spaced apart from an upper portion of the outsole by linking members disposed only near the medial edge or the lateral edge of the midsole; and a toe plate extending from the medial edge of the midsole to the lateral edge of the midsole and around an entirety of the anterior edge of the midsole, wherein a portion of the toe plate is spaced apart from and disposed entirely anterior of the first lower rib along an axis extending from a heel region of the article of footwear to a forefoot region of the article of footwear.

16. The article of footwear of claim 15, wherein a portion of the toe plate is spaced apart from the upper portion of the outsole.

17. The article of footwear of claim 15, wherein the outsole further includes a spine coupled to the first lower rib and the toe plate.

18. The article of footwear of claim 17, wherein the spine is included in the upper portion of the outsole.

19. The article of footwear of claim 1, wherein the first upper leg, the first lower leg, the second upper leg, and the second lower leg being flexibly attached to the uppermost portion of the outsole and the first lower rib allow the first lower rib to move about the medial and lateral linking members relative to the uppermost portion of the outsole.

20. The article of footwear of claim 15, wherein the toe plate is configured to articulate relative to the midsole.

* * * * *